United States Patent [19]

Yoshida

[11] Patent Number: 4,539,733

[45] Date of Patent: Sep. 10, 1985

[54] SEPARABLE SLIDE FASTENER

[75] Inventor: Hiroshi Yoshida, Kurobe, Japan

[73] Assignee: Yoshida Kogyo K. K., Tokyo, Japan

[21] Appl. No.: 537,806

[22] Filed: Sep. 30, 1983

[30] Foreign Application Priority Data

Sep. 30, 1982 [JP] Japan ..... 57-147074[U]
Oct. 23, 1982 [JP] Japan ..... 57-160430[U]

[51] Int. Cl.[3] ..... A44B 19/00

[52] U.S. Cl. ..... 24/396; 24/433; 24/394; 24/434

[58] Field of Search ..... 24/396, 397, 393, 394, 24/433, 434; 139/384 B; 112/265.2

[56] References Cited

U.S. PATENT DOCUMENTS

| | | | |
|---|---|---|---|
| 3,503,102 | 3/1970 | Inazawa | 24/434 X |
| 3,507,013 | 4/1970 | Inazawa | 24/434 |
| 3,540,084 | 11/1970 | Fröhlich | 24/393 X |
| 3,633,257 | 1/1972 | Heimberger | 112/265.2 X |
| 4,244,087 | 1/1981 | Akashi | 24/433 |
| 4,354,532 | 10/1982 | Tsubata | 139/384 B |
| 4,414,718 | 11/1983 | Kumano | 24/396 |
| 4,459,723 | 7/1984 | Takano et al. | 24/434 |

FOREIGN PATENT DOCUMENTS

| | | | |
|---|---|---|---|
| 2200444 | 7/1973 | Fed. Rep. of Germany | 24/396 |
| 1010956 | 11/1965 | United Kingdom | 24/396 |

*Primary Examiner*—Wiliam E. Lyddane
*Assistant Examiner*—Laurie K. Cranmer
*Attorney, Agent, or Firm*—Hill, Van Santen, Steadman & Simpson

[57] ABSTRACT

A separable slide fastener comprises a pair of stringer tapes each carrying on its inner longitudinal margins a row of coiled filamentary coupling elements sewn to the respective inner tape margin with a core thread extending through each of the coiled coupling element rows, and a separable bottom-end-stop assembly mounted adjacent to the bottom ends of the opposed tapes. The bottom-end-stop assembly includes a pair of separate pin members attached by clinching to the respective inner tape margins at bottom end portions thereof, which portions are devoid of coupling elements, and a socket member secured to one of the pin members and having a bore for receiving a portion of the other pin member. Each of the other pin member has a longitudinal channel receiving the element-free bottom end portion of the respective inner tape-margin. Before attachment of the pin members, the bottom end portion of each inner tape-margin is trimmed or shaped along its inner edge that projects inwardly from the core thread. Thus the inner tape-margin's bottom end portion has a width equal to the width of the channel of the respective pin member and smaller than the width of the remaining portion of the inner tape-margin.

4 Claims, 6 Drawing Figures

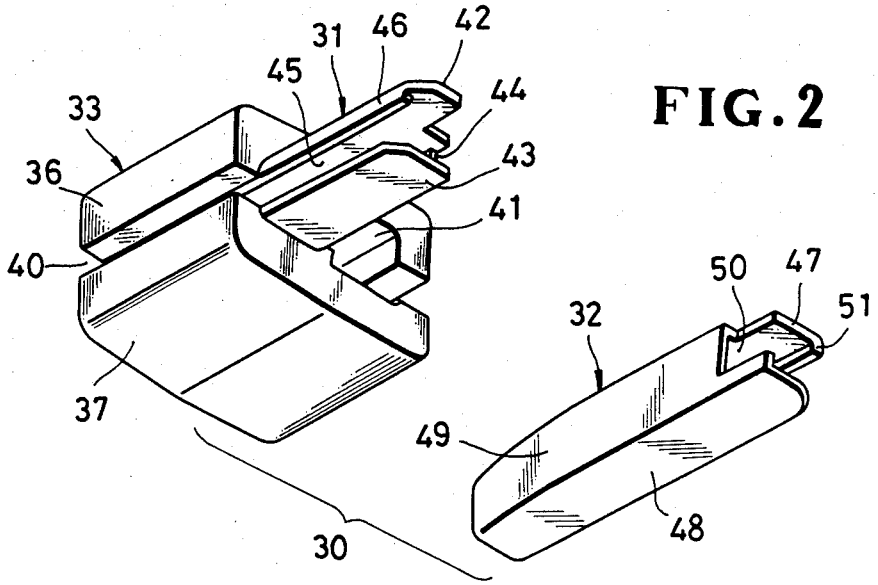
FIG. 2
FIG. 3
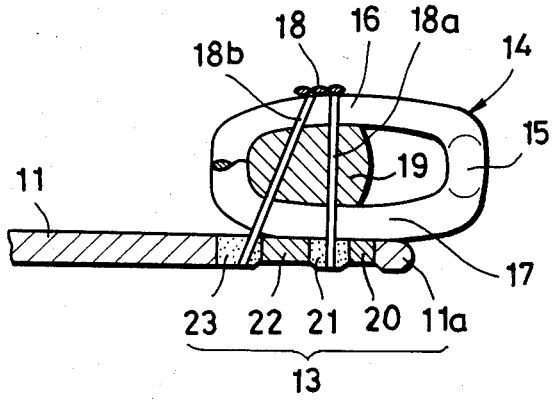

SEPARABLE SLIDE FASTENER

BACKGROUND OF THE INVENTION

1. Field of the Invention:

The present invention relates to a separable slide fastener having a separable bottom-end-stop assembly.

2. Prior Art:

There have been proposed various separable slide fasteners in which a separable bottom-end-stop assembly is mounted on adjacent bottom ends of opposed stringers including a pair of rows of coiled filamentary coupling elements of thermoplastic synthetic resin sewn to a pair of stringer tapes along their respective inner margins with a reinforcing core thread extending through each of the coupling element rows. The separable bottom-end-stop assembly comprises a pair of pin members secured by clinching to the inner tape margins at their respective bottom end portions. In an attempt to facilitate insertion of the bottom end portion of the tape's inner margin, the known pin member has a longitudinal channel with a relatively wide slot. However, this prior device is not satisfactory because the innermost edge of the tape's inner margin which projects inwardly from the core thread tends to be easily caught by the mouth of the pin member during insertion thereinto, thus impeding expeditious attachment of the pin member. Another problem with the prior device is that since the inner margin of the tape with the innermost edge folded needs to be received within the channel of the pin member, not only requiring a relatively great amount of force to clinch the pin member about the inner tape-margin, but also impairing flatness of the tape faces.

SUMMARY OF THE INVENTION

According to the present invention, a bottom-end-stop assembly is secured to bottom end portions of a stringer tape. Such assembly has a pair of pin members which has a longitudinal channel receiving an element-free bottom end portion of the respective inner tape-margin. Before attachment of the pin members, the bottom end portion of each inner tape-margin is trimmed or shaped along its inner edge that projects inwardly from a core thread. Thus the inner tape-margin's bottom end portion has a width equal to the width of the channel of the respective pin member and smaller that the width of the remaining portion of the inner tape-margin.

According to another aspect of the invention, the stringer tape is closely woven except a row or section of coarser weaving is provided at the coupling elements for sewing stitches to penetrate without producing puckering. Where a double lock stitch is used, two such rows or sections of coarse weaving underly the coupling elements, and this dual row coarse construction, with coupling elements removed, is received in the channel of each pin member.

It is therefore an object of the invention to provide a separable slide fastener in which a pair of separate pin members of a separable bottom-end-stop assembly can be attached to confronting inner tape-margins expeditiously with adequate accuracy.

Another object of the invention is to provide a separable slide fastener in which a pair of separate pin members of a separable bottom-end-stop assembly can be clinched about confronting inner tape-margins with such a small amount of force as not to impair flatness of the tape faces.

Still another object of the invention is to provide a separable slide fastener in which a pair of coiled filamentary coupling element rows can be sewn to confronting inner tape-margins without being easily displaced when lateral pulling force is exerted on the tapes.

Many other advantages, features and additional objects of the present invention will become manifest to those versed in the art upon making reference to the detailed description and the accompanying drawings in which preferred embodiments incorporating the principles of the present invention are shown by way of illustrative example.

BRIEF DESCRIPTION OF THE DRAWINGS

FIG. 2 is an enlarged exploded perspective view of a separable bottom end stop of the slide fastener of FIG. 1;

FIG. 3 is an enlarged fragmentary cross-sectional view taken along line III—III of FIG. 1, showing a fastener stringer;

DETAILED DESCRIPTION

Figure 1:
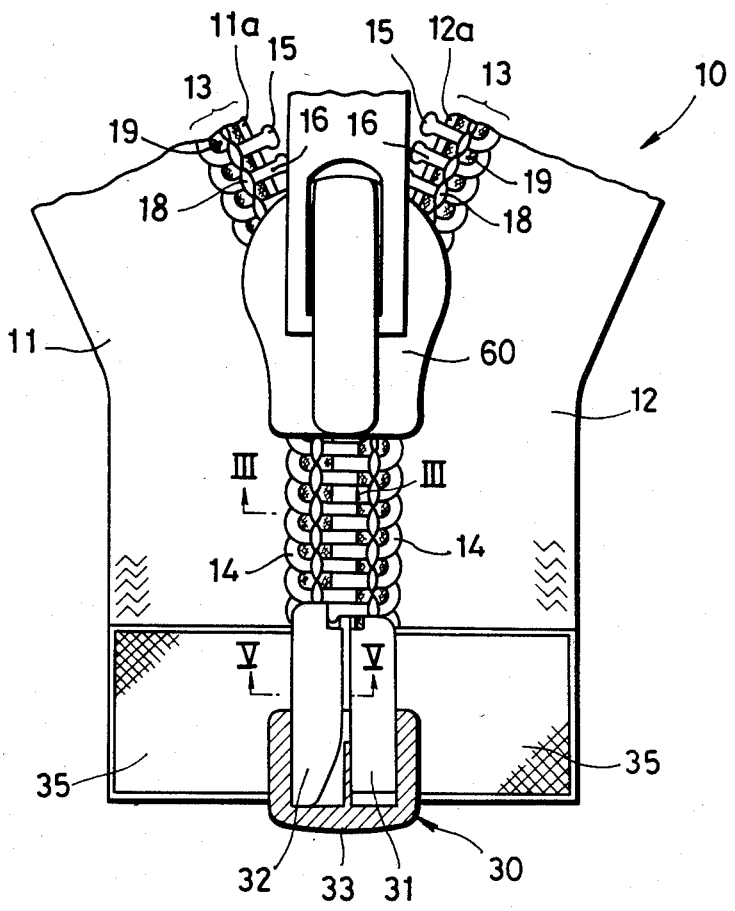
FIG. 1 is a fragmentary plan view of a separable slide fastener embodying the present invention.

As shown in FIG. 1, a separable slide fastener 10 comprises a pair of fastener stringers each including a stringer tape 11, 12 carrying on and along its inner longitudinal margin 13 a row of continuous coupling elements 14 in the form of a coiled filament made of thermoplastic synthetic resin. Each of the coupling elements 14 has a coupling head 15 and a pair of spaced upper and lower legs 16, 17 (the lower leg is shown in FIG. 3) extending from the coupling head 15 in a common direction. A slider 60 (FIGS. 1 and 4) is mounted on the opposed coupling element rows 14, 14 for movement therealong to close and open the slide fastener 10.

Each row of coupling elements 14 is secured to the tape 11, 12 by sewing stitches 18 of so-called "double locked stitch", with the lower leg 17 disposed against or in contact with the upper face of the inner tape-margin 13, and with the upper leg 16 disposed apart therefrom. A core thread or stuffer warp 19 is threaded through the coiled coupling element row 14 and extends along the entire length of the tape 11, 12.

Figure 4:
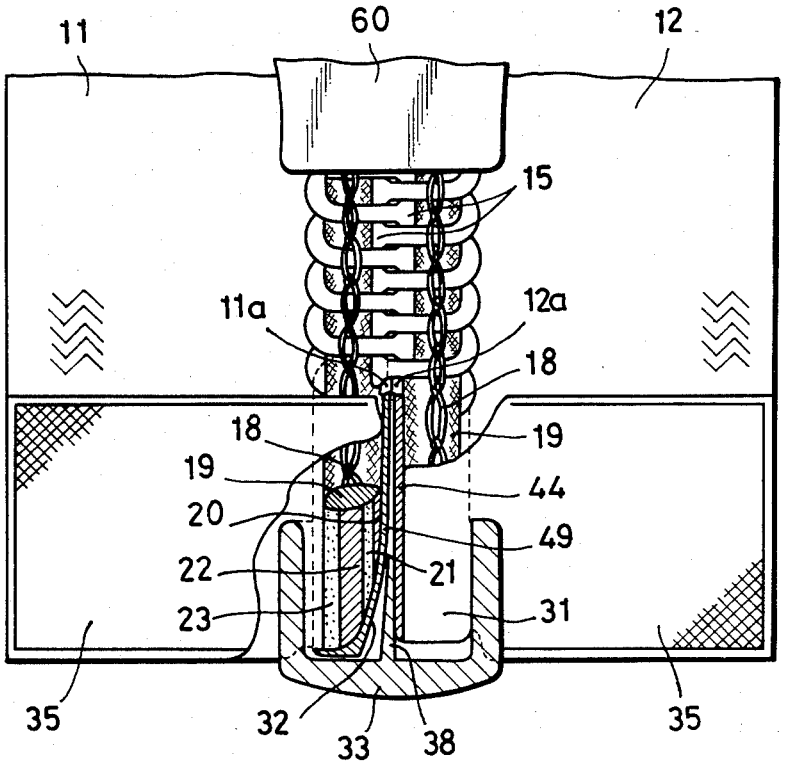
FIG. 4 is an enlarged plan view, with parts broken away, of FIG. 1.
Figure 5:
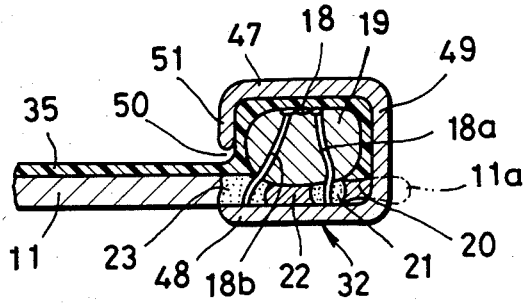
FIG. 5 is an enlarged fragmentary cross-sectional view taken along line V—V of FIG. 1.

As shown in FIGS. 3, 4 and 5, the inner tape-margin 13 has a close-and-coarse combined structure composed of a plurality of closely woven and coarsely woven sections 20, 21, 22, 23 extending longitudinally of the tape-margin 13 and disposed alternately thereacross. Specifically, the first and second closely woven section 20, 22 are spaced apart from one another with the first coarsely woven section 21 therebetween, and the first and second coarsely woven sections 21, 23 in turn are speced apart from one another with the second closely woven section 22 therebetween, the first coarsely woven section being spaced apart from the inner tape-edge 11*a*, 12*a* by the first closely woven section 20. Two threads 18*a*, 18*b* of the sewing stitches 18 extend over and around the upper leg 16 of each coupling element 14, then through the core thread 19 and then through the respective coarsely woven sections 21, 23. As a greater amount of tension is applied to the inner (right) thread 18*a* than on the outer (left) thread 18*b* during sewing, one sewing thread 18*a* lies at substantially a right angle to the tape 11, 12, and the other sewing thread 18*b* is inclined toward the inner tape-edge. Thus the two sewing threads 18*a*, 18*b* with the second closely woven section 22 provide generally a right triangle (FIG. 3). With this right triangular arrangement, the row of coupling elements 14 is attached to the tape 11, 12 stably without being easily displaced when lateral pulling force is exerted on the tape 11, 12.

The closely woven sections 20, 22 of the inner tape margin 13 are woven in plain weave. On the other hand, the coarsely woven sections 21, 23 are woven in basket weave, rib weave or herringbone weave with such a density of threads that the woven tape 11, 12 is prevented from being puckered or otherwise deformed due to penetration of the sewing threads 18*a*, 18*b* into the coarsely woven sections 21, 23.

A separable bottom-end-stop assembly 30 (FIGS. 1, 2, and 4) is mounted on adjacent bottom ends of the stringers at the respective bottom end portions of the confronting inner tape-margins 13, 13. The bottom end portion of each inner tape-margin 13 is devoid of several coupling elements 14, the number of which is not pertinent here. The separable bottom-end-stop assembly 30 includes a first separate pin member 31 secured by clinching to the bottom end portion of one of the inner tape-margins 13, a second separate pin member 32 secured by clinching to the bottom end portion of the other inner tape-margin 13, and a socket member 33 secured to the first pin member 31. A pair of reinforcing films 35, 35 (FIGS. 1, 4–6) is attached to the upper faces of the stringer tapes 11, 12, respectively, at the bottom ends thereof, each of the films 35 extending across the entire width of the respective tape 11, 12 and overlying at its inner margin both the bottom end portion of the respective inner tape-margin 13 and the bottom end portion of the core thread 19. The first pin member 31 and the socket member 33 may be formed integrally with one another.

Figure 6:
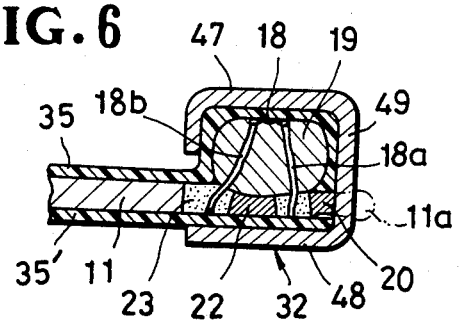
FIG. 6, appearing with FIG. 1, is a cross-sectional view similar to FIG. 5, showing a modified stringer.

Alternatively, as shown in FIG. 6, each fastener stringer may have an additional reinforcing film 35' of thermoplastic synthetic resin attached to the lower face of the stringer at its bottom end. The reinforcing film 35' extends across the entire width of the tape 11, 12 (only the tape 11 is shown for clarity) and underlies at its inner margin the bottom end portion of the respective inner tape-margin 13, the inner margin of the reinforcing film 35' being received in the respective pin member 31, 32 (only the pin member 32 is shown for clarity).

As shown in FIG. 2, the socket member 33 has a pair of flanged upper and lower wings 36, 37 joined by a partition wall 38 (FIG. 4) extending centrally of the wings 36, 37 to form a pair of longitudinal bores 40, 41, one base 40 for receiving the first pin member 31, and the other bore 41 for receiving a portion of the second pin member 32. The first pin member 31 extends from the upper end of the socket member 33 and has a pair of upper and lower plates 42, 43 interconnected at one edge by a side wall 44 to define therebetween a longitudinal channel 45 communicating with one bore 40 of the socket member 33. The bottom end portion of the inner tape-margin 13, the inner margin of the reinforcing film 35, the bottom end portion of the core thread 19, and the sewing stitches 18 are snugly received in the channel 45 of the first pin member 31 when the latter is attached to the stringer tape 12. The upper plate 42 extends beyond the top ends of the lower plate 43, and has at the other edge a longitudinal flange 46 projecting therefrom toward the lower plate 43.

The second pin member 32, like the first pin member 31, has a pair of upper and lower plates 47, 48 interconnected at one edge by a side wall 49 to define therebetween a longitudinal channel 50 for receiving the bottom end portion of the inner tape-margin 13, the inner margin of the reinforcing film 35, the bottom end portion of the core thread 19, and the sewing stitches 18. The upper plate 47 has at its other edge a longitudinal flange 51 extending toward the lower plate 48.

Before the separable bottom-end-stop assembly 30 is attached to the bottom ends of the opposed stringers, the bottom end portion of each inner tape-margin 13 is trimmed along its inner edge 11*a*, 12*a* (FIGS. 1, 3–5) in conformity with the shape of the channel 45, 50 of the respective pin member 31, 32, and thus has a width equal to the width of the channel 45, 50 of the respective pin member 31, 32 and smaller than the width of the remaining portion of the respective inner tape-margin 13. Having thus been trimmed, the bottom end portion of each inner tape-margin 13 can be threaded through the respective pin member 31, 32 easily and speedily without being caught by the pin member's upper mouth. Further, with this arrangement, each pin member 13 can be attached to the respective inner tape-margin 13 accurately with an adequate fit, at which time the inner tape margin 13 needs not to be folded along its inner edge. (Otherwise if the inner tape margin 13 with the inner edge folded were received in the pin member 31, 32, the tape 11, 12 would tend to be objectionably deformed at the bottom end, impairing its flatness even when such tape end is reinforced by a thermoplastic synthetic film.)

Although various minor modifications may be suggested by those versed in the art, it should be understood that I wish to embody within the scope of the patent warranted hereon, all such embodiments as reasonalby and properly come within the scope of my contribution to the art.

What is claimed is:

1. A separable slide fastener, comprising:

(a) pair of fastener stringers each including a stringer tape carrying on its inner longitudinal margin a row of continuous coupling elements, there being a core thread extending through said row of coupling elements and extending along the entire length of said stringer tape, each of said coupling elements having a coupling head and a pair of spaced legs extending from said coupling head in a common direction, said inner tape-margin having a bottom end portion devoid of coupling elements;

(b) sewing stitches securing said row of coupling elements to said inner tape-margin, with one leg of each coupling element disposed against one face of said inner tape-margin and with the other leg disposed apart from said one face of said inner tape-margin;

(c) a separable bottom-end-stop assembly mounted on adjacent bottom ends of said stringers and including (2) a pair of separate pin members secured to the respective stringers, each of said pin members having a longitudinal channel receiving said bottom end portion of said inner tape-margin together with a bottom end portion of said core thread, and (2) a socket member secured to one of said pin members and having a bore for receiving a portion of the other pin member; and (d) said bottom end portion of each said inner tape-margin having a shape along its inner edge in conformity to the shape of said channel of the respective pin member and thus having a width equal to the width of said channel of the respective pin member and smaller than the width of the remaining portion of said inner tape-margin.

2. A separable slide fastener according to claim 1, said inner longitudinal margin of said stringer tape comprising a plurality of closely woven and coarsely woven sections underlying said coupling elements extending longitudinally of said inner tape-margin and juxtaposed alternately thereacross, said sewing stitches extending over and around said other leg of each coupling element, then through said core thread and then through said coarsely woven sections of said inner tape margin.

3. A separable slide fastener according to claim 1, including a first reinforcing film of thermoplastic synthetic resin attached to one face of each stringer at its bottom end, said first reinforcing film extending across the entire width of the stringer tape and overlying at its inner margin both said bottom end portion of said inner tape-margin and said bottom end portion of said core thread, said inner margin of said first reinforcing film being received in the respective pin member.

4. A separable slide fastener according to claim 3, further including a second reinforcing film of thermoplastic synthetic resin attached to the other face of each stringer at its bottom end, said second reinforcing film extending across the entire width of the stringer tape and underlying at its inner margin said bottom end portion of said inner tape margin, said inner margin of said second reinforcing film being received in the respective pin member.

* * * * *